United States Patent [19]

Coleman et al.

[11] 4,445,593

[45] May 1, 1984

[54] FLAT TYPE FEEDER CABLE

[75] Inventors: John D. Coleman; Donald L. Obst; Heinrich A. Kraft, all of Hickory, N.C.

[73] Assignee: Siecor Corporation, Hickory, N.C.

[21] Appl. No.: 434,507

[22] Filed: Oct. 15, 1982

[51] Int. Cl.[3] ..... H01B 7/08; B66B 9/00

[52] U.S. Cl. ..... 187/1 R; 57/204; 174/113 C; 174/117 F; 174/131 R

[58] Field of Search ..... 174/117 R, 117 F, 131 A, 174/131 B, 131 R, 113 C; 187/1 R; 57/204, 293

[56] References Cited

U.S. PATENT DOCUMENTS

| | | | |
|---|---|---|---|
| 3,324,233 | 6/1967 | Bryant | 174/131 R |
| 3,344,888 | 10/1967 | Connelly et al. | 174/131 R |
| 4,058,186 | 11/1977 | Mullis | 174/70 R X |
| 4,084,065 | 4/1978 | Swenson | 174/131 A |
| 4,227,041 | 10/1980 | Den et al. | 174/117 F |

FOREIGN PATENT DOCUMENTS

| | | | |
|---|---|---|---|
| 1004253 | 3/1957 | Fed. Rep. of Germany | 174/117 F |
| 2306386 | 8/1974 | Fed. Rep. of Germany | 174/117 F |
| 2330673 | 12/1974 | Fed. Rep. of Germany | 174/117 F |
| 989718 | 9/1951 | France | 174/131 B |

*Primary Examiner*—J. V. Truhe
*Assistant Examiner*—Morris H. Nimmo
*Attorney, Agent, or Firm*—Roy B. Moffitt

[57] ABSTRACT

A flat type feeder cable useful for transmitting electrical energy from a stationary source to a moving apparatus, which has a plurality of spaced apart strength members each with their respective axes arranged in a line and in substantially coplanar relationship with one another; a plurality of strand members stranded together about each of the strength members to form a core, the strand members themselves being composed of a plurality of electrical conductors circumscribed by a sheath, and are "S-Z" stranded so that they contain first and second alternatingly repeating substantially equal first and second sections, each of said first sections having a common direction and degree of lay and each of said second sections also having a common direction and degree of lay substantially equal opposite to that of the first sections, and, a jacket of flexible material circumscribing the core members.

10 Claims, 10 Drawing Figures

FLAT TYPE FEEDER CABLE

BACKGROUND OF THE INVENTION

The instant invention relates to a flat type feeder cable useful for feeding electrical power or data from a fixed or stationary electrical power or data supply terminal to a moving apparatus such as an elevator. More particularly, this invention relates to a flat type feeder cable for feeding electrical power or data from a stationary terminal to a moving apparatus such as an elevator disposed to travel vertically in a narrow or restricted space, i.e., an elevator well.

A feeder cable connected at one end to a stationary source of electrical energy and its other end connected to a moving apparatus is generally referred to as a traveling/lighting or moving cable. After installation, use of the cable involves repeatedly subjecting the cable to various types of mechanical action resulting in bending and torsion. Because a feeder cable used in connection with an elevator is suspended between a fixed electrical power or data supplying terminal at one of its ends and the other end terminated in the elevator, the intermediate portion of the cable naturally hangs in a bent U shape configuration. This bent portion is caused to shift along this entire length in response to the up and down movement of the elevator car, thus subjecting the cable to repeated bending action over its entire length. Any cable used for this purpose must possess excellent flexibility in order to withstand such repeated bending.

The prior art has recognized the problems associated with feeder cable and has attempted to solve the problem in several ways, one of which is disclosed in U.S. Pat. No. 4,227,041. This disclosure attempts to solve the feeder cable problems by an arrangement using a plurality of even numbered cores, each core being made from a plurality of strands and each strand being made from a plurality of stranded copper conductors surrounded by a jacket. One-half of the cores are so constructed that the strands of the cores have a direction of lay in one direction ("S" stranding for example) and the balance of the strands are made from cores that have a direction of lay opposite from that of the first mentioned strand ("Z" stranding for example). Even though this prior art discloses strength members, such strength members are always disclosed as being embedded in a jacket that surrounds the strands. Applicant has found that most if not all of the load (tensile) stresses one encounters in a feeder cable system employing the feeder cable of U.S. Pat. No. 4,227,041 falls mainly on the electrical conductors, not on any strength members that may be present. This prior art teaching contemplates an even number of stranded members, one-half of which have a direction and degree of lay opposite from that of the other half throughout the entire length of each strand.

Applicants have discovered a S-Z type stranded cable construction that permits all of the tensile stress applied to the cable to be placed solely on strength members and further permits an even or odd number of stranded members.

The foregoing features of the present invention will be apparant to those skilled in the art from the following detailed description taken in connection with accompanying drawings in which:

BRIEF DESCRIPTION OF THE DRAWINGS

FIG. 1(*b*) is a strand having a "Z" or right-handed lay and FIG. 1(*c*) is a strand having a "SZ," both right and left-handed lay.

DETAILED DESCRIPTION OF THE INVENTION

Figure 1:
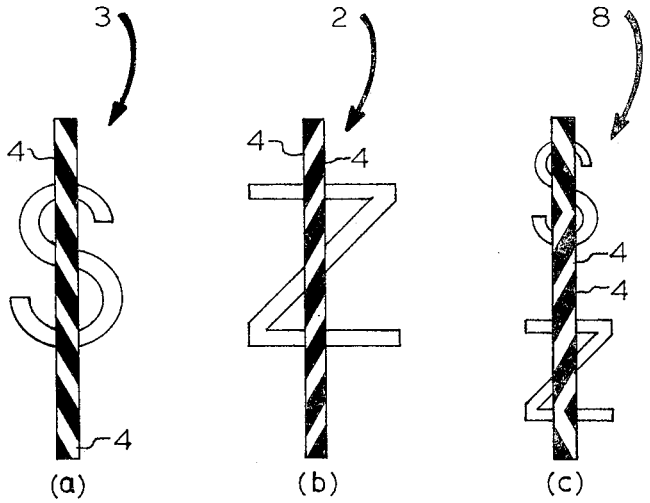
FIGS. 1(*a*), 1(*b*) and 1(*c*) are schematic representation of a strand employing elements (strands) twisted or stranded together in various modes: namely FIG. 1(*a*) is a strand having an "S" or left-handed lay.

FIG. 1(*a*) shows a well known "S" type stranded member denoted by arabic numeral 3. The member is made up of a plurality of strands 4 twisted together so that the lay of the strands is all in one direction, essentially following the median portion of the letter "S"; thus the terminology "S" type. FIG. 1(*b*) shows a "Z" type stranded member denoted by the element number 2. It too is made up of a plurality of strands 4 twisted in such a manner that the lay of such strands are right-handed, i.e., lying in the same same direction of the medium portion of the letter "Z," thus, the terminology "Z" stranded. FIG. 1(*c*) is a "S-Z" type stranded member made up of a plurality of strands 4 stranded in such a way that the lay of the strands 4 is "Z" for a predetermined length of the strand and then, abruptly, the lay of the strands 4 is changed so that the member is "S" for a predetermined length.

The instant invention contemplates an "S-Z" stranded cable composed of a core 8 having "S" type lay for a given length and then a "Z" type of lay for the same length. Strand members 4 are "S-Z" stranded so that they contain first and second alternatingly repeating essentially equal first and second sections, each of said first sections having a common direction and degree of lay, each of said second sections also having a common direction and degree of lay substantially equal to but opposite to that of the first section. The first section of core 8 is denoted by the letter "x" and the second section being denoted by the letter "y" with length "x" equal to length "y" and, in this particular embodiment length "x" being "S" stranded and length "y" being "Z" stranded.

Figure 3:
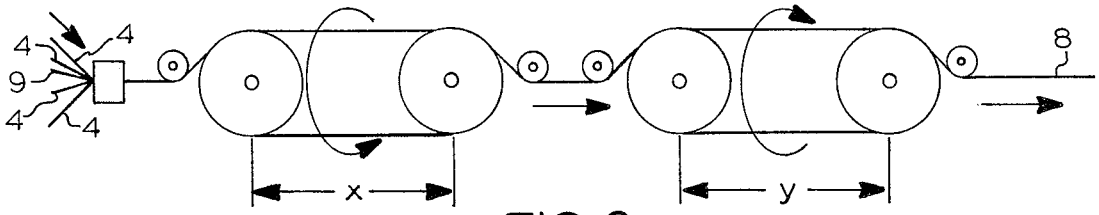
FIG. 3 is a schematic representation of prior art apparatus employed in stranding S-Z type strands.
Figure 4:
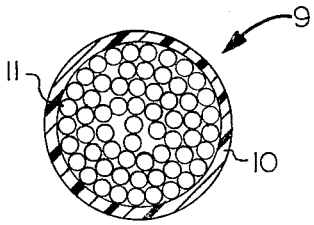
FIG. 4 is a cross section of a strength member about which strands of FIG. 5 are stranded to form core of FIG. 6.

FIG. 3 shows conventional prior art apparatus used to "S-Z" strand strands 4. For the purpose of this invention, length "x" equals length "y," such "x" and "y" lengths being manufactured by "breathing" accumulators. Another apparatus adapted to make "S-Z" stranded members is shown by U.S. Pat. No. 3,823,536, such disclosure being incorporated herein by reference.

Figure 5:
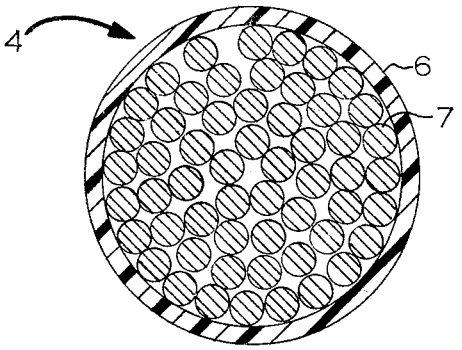
FIG. 5 is a cross section of a strand member used with other like strand members to form a S-Z strand as shown in FIG. 2.

Strands 4 used to form stranded core member 8 shown by element 4 in FIG. 5 and are composed of electrical conductors 7 (made from any suitable material such as copper) circumscribed by a plastic sheath 6, also made from any suitable material such as polyamide, polyvinyl chloride, polyurethane and polyolefins. Strands 4 are twisted about strength member 9 to form cores 8. Element 9 denotes a strength member made from elongated members 11 surrounded by plastic sheath 10. Elongated members 11 of strength members 9 can be made from any suitable materials such as steel, graphite, aramids, polyamids, or any suitable materials that has high tensile strength and can be formed into an elongated members. Sheath 10 can be made from any suitable plastic such as polyolefin, polyvinyl chloride, polyurethane, rubber and elasticoneric material.

Figure 2:
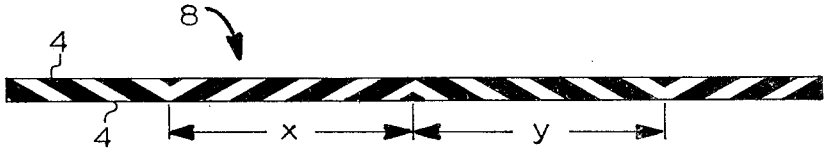
FIG. 2 is a schematic representation of a S-Z strand of FIG. 1(*c*) stranded so that the sum of the right-handed and left-handed lays is zero.
Figure 6:
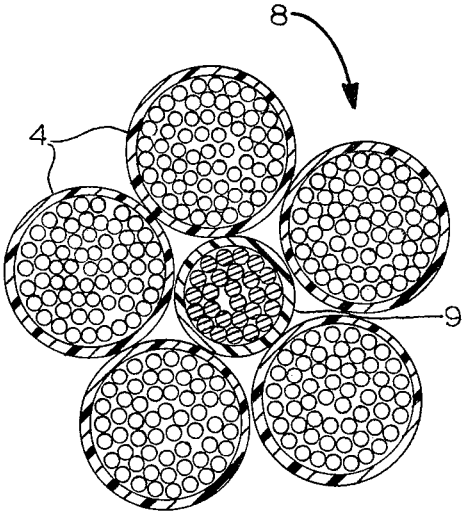
FIG. 6 is a cross section of an S-Z type strand shown diagrammatically in FIG. 2 employing a plurality of strands as shown in FIG. 5 and a center strength member as shown in FIG. 4 to form a core.

Strength member 9 forms a center piece, as shown in FIG. 6, and strands 4 are twisted about it to form core 8. Each one of the strands 4 are twisted in such a way so that they are S-Z stranded, like that shown in FIG. 2; namely, there are first and second alternating repeatingly substantially equal first and second sections (x and y), each of said first sections having a common direction and degree of lay and each of said second sections also having a common direction and degree of lay substantially equal to but opposite to that of the first section.

Figure 7:
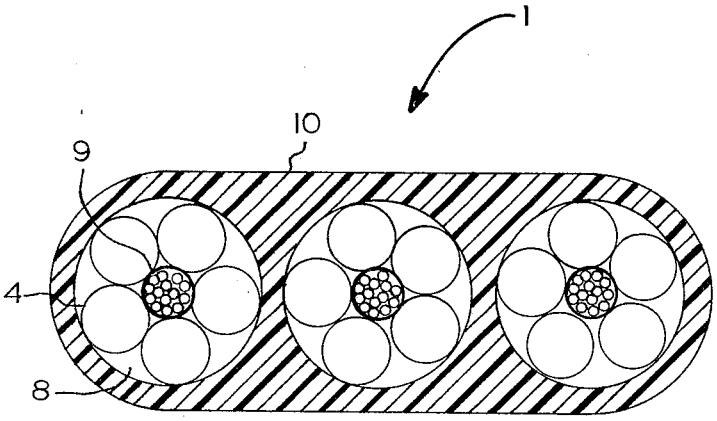
FIG. 7 is a cross section of a flat S-Z type stranded cable of the invention along lines 7—7 of FIG. 8.

FIG. 7 is a cross section of the cable 1 of the instant invention. It will be noted that cable 1 comprises a plurality of spaced apart strength members 9 each with their respective axis arranged in a line and in substantially co-planar relationship with one another. Strand members 4, as previously described, are made up into a composite core 8 comprising strength members 9 surrounded by strands 4. Strands 4 are S-Z stranded as previously described to form the composite core member 8. Circumscribing each composite 8 is a jacket of flexible material 10, which can be made from any of the materials such as rubber, polyurethane, polyolefins, polyvinyl chloride or polyamide.

Figure 8:
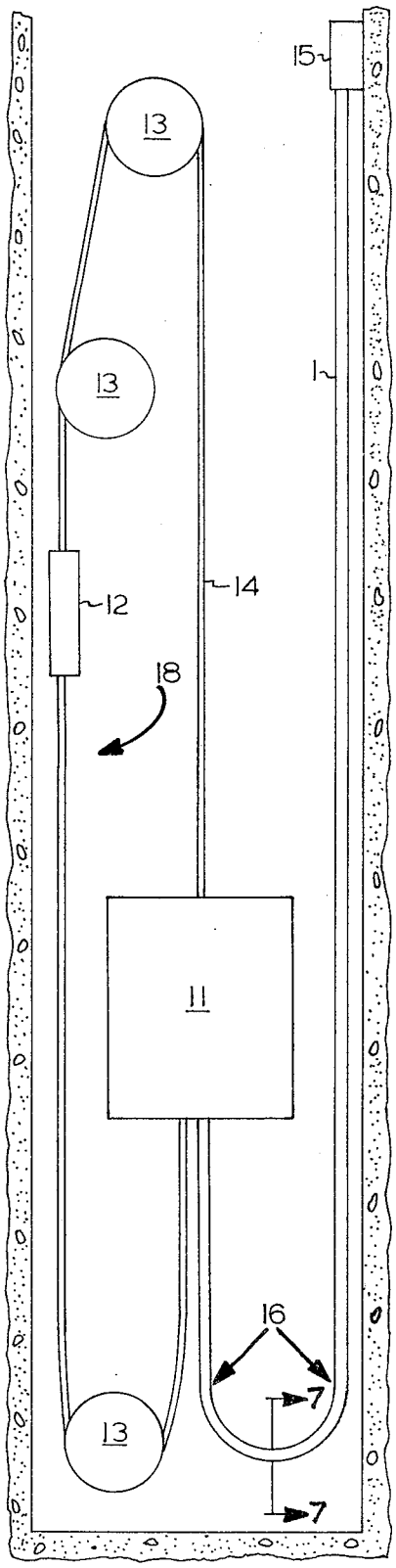
FIG. 8 is a diagramatic representation of an elevator system employing the flat feeder type cable of the instant invention.

FIG. 8 schematically discloses the environment in which the cable of the instant invention is employed, i.e., elevator well or shaft. It is to be understood that FIG. 8 is diagrammatic in nature and is not extended to be a detailed description of an elevator system.

Element 11 represents the elevator car or cab suspended by hoist rope 14 which traverses over pulleys 13 and is attached to elevator counterweight 12. Attached to the bottom of counterweight 12 is compensating cable 18, which may be traversed over pulley 13 and attached to car or cab 11. The traveling and lighting cable 1 of the instant invention is shown attached to car or cab 11 and to a fixed terminal 15 on the sidewalls of the elevator shaft. Element 16 denotes a "U" shape bend of feeder cable 1 normally expected in such an arrangement. This "U" shape bend traverses up and down the elevator well 17 as car 11 goes up and down, such being, the "bent portion" referred to in the earlier part of this specification. More particularly, this bent portion 16 is caused to shift along the entire length of the traveling and lighting cable in response to the up and down movement of the elevator car. Such a shifting subjects the cable to repeated bending action over the entire length of cable 1. Applicants have found that the structure of the cable disclosed herein possesses the excellent flexibility that is necessary in order to withstand such repeated bending. Furthermore, they further found that the tensile load carried by the cable, primary the weight of the cable itself, would be borne primarily by the electrical conductors 7 if it were not for the load bearing member 9, which because of the unique cable structure of this invention these load bearing member(s) carry substantially all of such load.

Although the invention has been described in considerable detail, such detailed description is only for the purpose of illustrating the specific embodiments. It is evident that variations and modifications can be made from those described without departing from the spirit and scope of the invention.

What is claimed is:

1. A flat type feeder cable useful for transmitting electrical energy from a stationary source to a moving apparatus comprising:

(a) a plurality of spaced apart strength members each with their respective axes arranged in a line and in substantially coplanar relationship with one another;

(b) a plurality of strand members stranded together about each of said strength members to form a core, said strand members comprising a plurality of electrical conductors circumscribed by a sheath and forming first and second alternatingly repeating, substantially equal length, first and second sections, each of said first sections having a common direction and degree of lay and each of said second sections also having a common direction and degree of lay substantially equal to but opposite to that of the first sections; and (c) a jacket of flexible material circumscribing said core members.

2. The feeder cable of claim 1 wherein said strength members are circumscribed by a jacket of flexible material.

3. The feeder cable of claim 2 wherein said strength members are made from materials selected from the group comprising polyamide, polyolefins, aramids, steel and graphite.

4. The feeder cable of claim 2 wherein said flexible material is made from a material selected from the group comprising rubber, polyvinyl chloride, polyurethane, and polyamide.

5. The feeder cable of claim 1 wherein said sheath circumscribing the the electrical conductors of the strands is made from materials selected from the group comprising rubber, polyolefins, polyvinyl chloride, polyurethanes and polyamide.

6. An elevator system comprising a car, a feeder cable and a stationary terminating means, the feeder cable connected to the car and said stationary terminating means, the improvement wherein said feeder cable comprises:

(a) a plurality of spaced apart strength members each with their respective axes arranged in a line and in substantially coplanar relationship with one another;

(b) a plurality of strand members stranded together about each of said strength members to form a core, said strand members comprising a plurality of electrical conductors circumscribed by a sheath and forming first and second alternatingly repeating, substantially equal length, first and second sections, each of said first sections having a common direction and degree of lay and each of said second sections also having a common direction and degree of lay substantially equal to but opposite to that of the first sections; and (c) a jacket of flexible material circumscribing said core members.

7. The elevator system of claim 6 wherein said strength members are circumscribed by a jacket of flexible material.

8. The elevator system of claim 6 wherein said strength members are made from plastic materials selected from the group consisting of polyamide, steel, polyolefins, aramids, and graphite.

9. The elevator system of claim 6 wherein said sheath surrounding the electrical conductors of the strands is made from materials selected from the group consisting of rubber, polyolefins, polyvinyl chloride, polyurethanes and polyamide.

10. The elevator system of claim 7 wherein the flexible material circumscribing the strength members is made from materials selected from the group consisting of rubber, polyolefins, polyvinyl chloride, polyurethanes and polyamide.

* * * * *